US007485008B1

(12) United States Patent
Yi et al.

(10) Patent No.: US 7,485,008 B1
(45) Date of Patent: Feb. 3, 2009

(54) ELECTRICAL CONNECTOR WITH IMPROVED CONTACTS ARRANGEMENT

(75) Inventors: Chong Yi, Mechanicsburg, PA (US); Kevin E. Walker, Hershey, PA (US); Kuan-Yu Chen, Harrisburg, PA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/148,278

(22) Filed: Apr. 17, 2008

(51) Int. Cl.
*H01R 17/00* (2006.01)

(52) U.S. Cl. ..... 439/660

(58) Field of Classification Search ..... 439/660, 439/924.1, 607
See application file for complete search history.

(56) References Cited

U.S. PATENT DOCUMENTS 3,831,133 A * 8/1974 Grundfest ..... 439/680
4,201,432 A * 5/1980 Chalmers ..... 439/82
6,036,549 A * 3/2000 Wulff ..... 439/660
6,447,340 B1 * 9/2002 Wu ..... 439/660
6,699,049 B1 * 3/2004 Wu ..... 439/79
7,021,971 B2 4/2006 Chou et al.
7,104,848 B1 9/2006 Chou et al.
7,108,560 B1 9/2006 Chou et al.
7,125,287 B1 10/2006 Chou et al.
7,128,617 B2 10/2006 Wang et al.
7,134,884 B2 11/2006 Wang et al.
2007/0218762 A1 9/2007 Liao et al.

* cited by examiner

*Primary Examiner*—Tho D Ta
(74) *Attorney, Agent, or Firm*—Wei Te Chung

(57) ABSTRACT

An electrical connector (100, 200) includes an insulative body (10, 50), a shell (20, 60), a number of first contacts (30, 70) and second contacts (40, 80). The insulative body includes a seat (12, 52) and a mating plate (18, 58) projecting outwardly from the seat, which has opposite first and second sides. The mating plate has a first mating section (184, 186) and a second mating section (186, 586) behind the first mating section. The second mating section is thicker than the first mating section. The shell surrounds the seat and the mating plate and defines an opening at a front end thereof. Each first and second contact includes a contact ends (32, 72, 42, 82) arranged on the first mating section and the second mating section, respectively. The contact ends of the first and second contacts are located on the same side of the mating plate.

14 Claims, 12 Drawing Sheets

ELECTRICAL CONNECTOR WITH IMPROVED CONTACTS ARRANGEMENT

BACKGROUND OF THE INVENTION

1. Field of the Invention

The present invention relates generally to electrical connector, and more particularly to a connector having improved contacts arrangement.

2. Description of Related Art

Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mousse, keyboards, PDAs, gamepads and joysticks, scanners, digital cameras, printers, external storage, networking components, etc. With more than 2 billion legacy wired (USB) connections in the world today, USB is the de facto standard in the personal computing industry.

As of 2006, the USB specification is at version 2.0 (with revisions). The USB 2.0 specification was released in April 2000 and was standardized by the USB-IF at the end of 2001. Previous notable releases of the specification were 0.9, 1.0, and 1.1. Equipment conforming to any version of the standard will also work with devices designed to any previous specification (known as: backward compatibility).

The USB 2.0 specification defines the following connectors: standard A plug and receptacle, standard B plug and receptacle, and mini-B plug and receptacle. Since USB has become a popular interface for exchanging data between cell phone and portable devices. Many of these devices have become so small it is impossible to use standard USB components as defined in the USB 2.0 specification. In addition the durability requirements of the cell phone and portable devices market exceed the specifications of the current interconnects. In addition, cell phone and portable devices have become so thin that the current mini-USB dose not fit well within the constraints of future designs. Additional requirements for a more rugged connector that still meet the USB 2.0 specification for mechanical and electrical performance was also a consideration. The mini-USB could not be modified and remain backward compatible to the existing connector as defined in the USG OTG specification. Since cell phone and other small portable devices are the largest market potential for USB, USB-IF published Micro-USB Cables and Connectors Specification to the USB 2.0 Specification, Revision 1.01 as of Apr. 4, 2007.

USB supports three data rates: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s). Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed; 3) A Hi-Speed rate of up to 480 Mbit/s (60 MB/s). Though Hi-Speed devices are commonly referred to as "USB 2.0" and advertised as "up to 480 Mbit/s", not all USB 2.0 devices are Hi-Speed. Hi-speed devices typically only operate at half of the full theoretical (60 MB/s) data throughput rate. Most hi-speed USB devices typically operate at much slower speeds, often about 3 MB/s overall, sometimes up to 10-20 MB/s. A data transmission rate at 20 MB/s is sufficient for some but not all applications. However, under a circumstance transmitting an audio or video file, which is always up to hundreds MB, even to 1 or 2 GB, currently transmission rate of USB is not sufficient. As a consequence, faster serial-bus interfaces are being introduced to address different requirements. PCI Express, at 2.5 GB/s, and SATA, at 1.5 GB/s and 3.0 GB/s, are two examples of high-speed serial bus interfaces.

From an electrical standpoint, the higher data transfer rates of the non-USB protocols discussed above are highly desirable for certain applications. However, these non-USB protocols are not used as broadly as USB protocols. Many portable devices are equipped with USB connectors other than these non-USB connectors. One important reason is that these non-USB connectors contain a greater number of signal pins than an existing USB connector and are physically larger as well. For example, while the PCI Express is useful for its higher possible data rates, a 26-pin connectors and wider card-like form factor limit the use of Express Cards. For another example, SATA uses two connectors, one 7-pin connector for signals and another 15-pin connector for power. Due to its clumsiness, SATA is more useful for internal storage expansion than for external peripherals. As discussed above, the existing USB connectors have a small size but low transmission rate, while other non-USB connectors (PCI Express, SATA, et al) have a high transmission rate but large size. Neither of them is desirable to implement modern high-speed, miniaturized electronic devices and peripherals.

To provide a kind of connector with a small size and a high transmission rate for portability and high data transmitting efficiency is much desirable. It has previously been proposed to extend the length of the plug and receptacle tongue portions of the existing USB standard-A connectors and to extend depth of the receiving cavity of the existing USB standard-A connectors, thereby to accommodate additional contacts in extended areas; or to provide the additional contacts on a reverse-side of the plug tongue portion and accordingly with regard to receptacle, to provide a lower tongue portion under a top receptacle tongue portion thereby four USB contacts are hold on the top tongue portion and additional contacts are accommodated on the lower tongue portion of the receptacle. To extending the length of the receptacle tongue portions of the existing USB standard-A connectors, it still hasn't an efficient proposal to assure the mating position when the existing USB plug inserted therein for backward compatibility. With contrast with existing USB standard-A receptacle, the receptacle with top and lower tongue portion is higher in height than existing USB receptacle. To achieve this object, at least eight contacts need to be added. Adding eight contacts in existing USB connector is not easy. As discussed above, the receptacle equipped with two tongue portions or plug and receptacle both with a longer length are also clumsiness. That is not very perfect from a portable and small size standpoint.

It has also previously been proposed to add additional five contacts to the existing mini-B USB receptacle. The original five contacts of mini-B receptacle are arranged on one side of the tongue and the additional contacts are arranged on the other side thereof. Therefore, the receptacle with additional contacts can receive an existing mini-B plug or another plug with five contacts for transmitting non-USB signals. When the plug for transmitting non-USB signals inserted into the receptacle, the five contacts thereof contact with the additional contacts of the receptacle, while the original contacts don't work. Although the receptacle is able to transmit both USB or non-USB signals, but the choice is selectively, the original and the additional contacts can't work simultaneously. Therefore, it is useless for increasing high-speed signal.

Hence, it is desired to provide an electrical connector to overcome the problems mentioned above.

BRIEF SUMMARY OF THE INVENTION

An electrical connector includes an insulative body, a shell, a plurality of first contacts, and a plurality of second contacts. The insulative body includes a seat and a mating plate projecting outwardly from the seat which has opposite first and second sides. The mating plate further has a first mating section at a front end thereof and a second mating section behind the first mating section. The second mating section is thicker than the first mating section. The shell surrounds the seat and the mating plate and defines an opening at a front end thereof. Each first and second contact comprises a contact end arranged on the first mating section and the second mating section, respectively. The contact ends of the first and second contacts are located on the same side of the mating plate.

An electrical connector assembly includes a receptacle and a plug matable with the receptacle. The receptacle includes an insulative body comprising a seat and a scalar mating plate projecting outwardly from the seat. The mating plate has a first step and a second step located between the first step and the seat. A plurality of first contacts and second contacts are arranged on the first step and the second step, respectively. The plug includes an insulative seat and a scalar mating plate projecting from the seat. The mating plate of the plug including a first step and a second step located between the first step and the seat. A plurality of third and forth contacts are arranged on the first step and the second step of the plug respectively. The third and forth contacts are mating with the second and first contacts of the receptacle.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
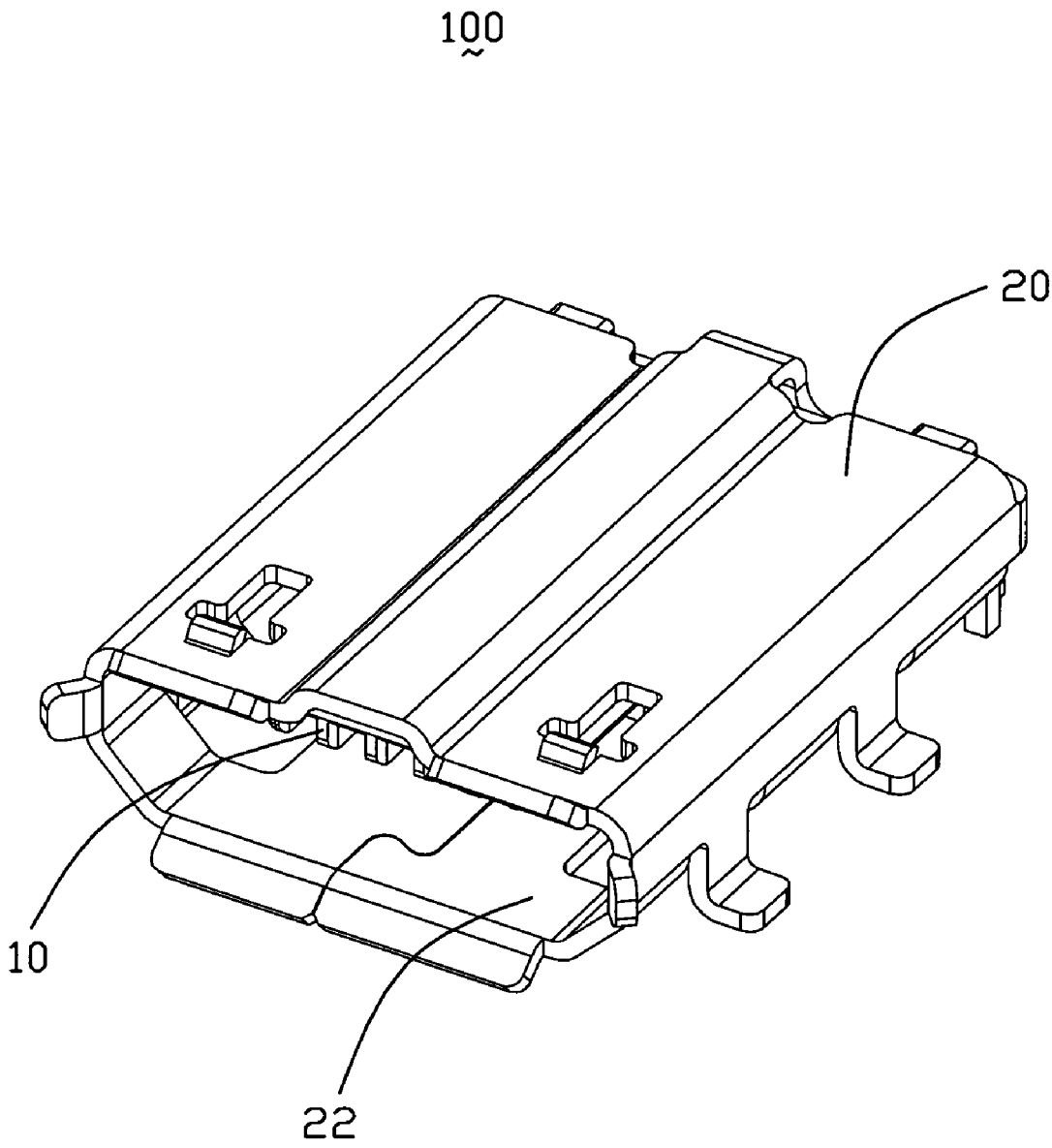
FIG. 1 is a perspective view of an electrical receptacle according to the present invention.

Reference will be made to the drawing figures to describe the present invention in detail, wherein depicted elements are not necessarily shown to scale and wherein like of similar elements are designated by same or similar reference numeral through the several views and same or similar terminology.

Figure 2:
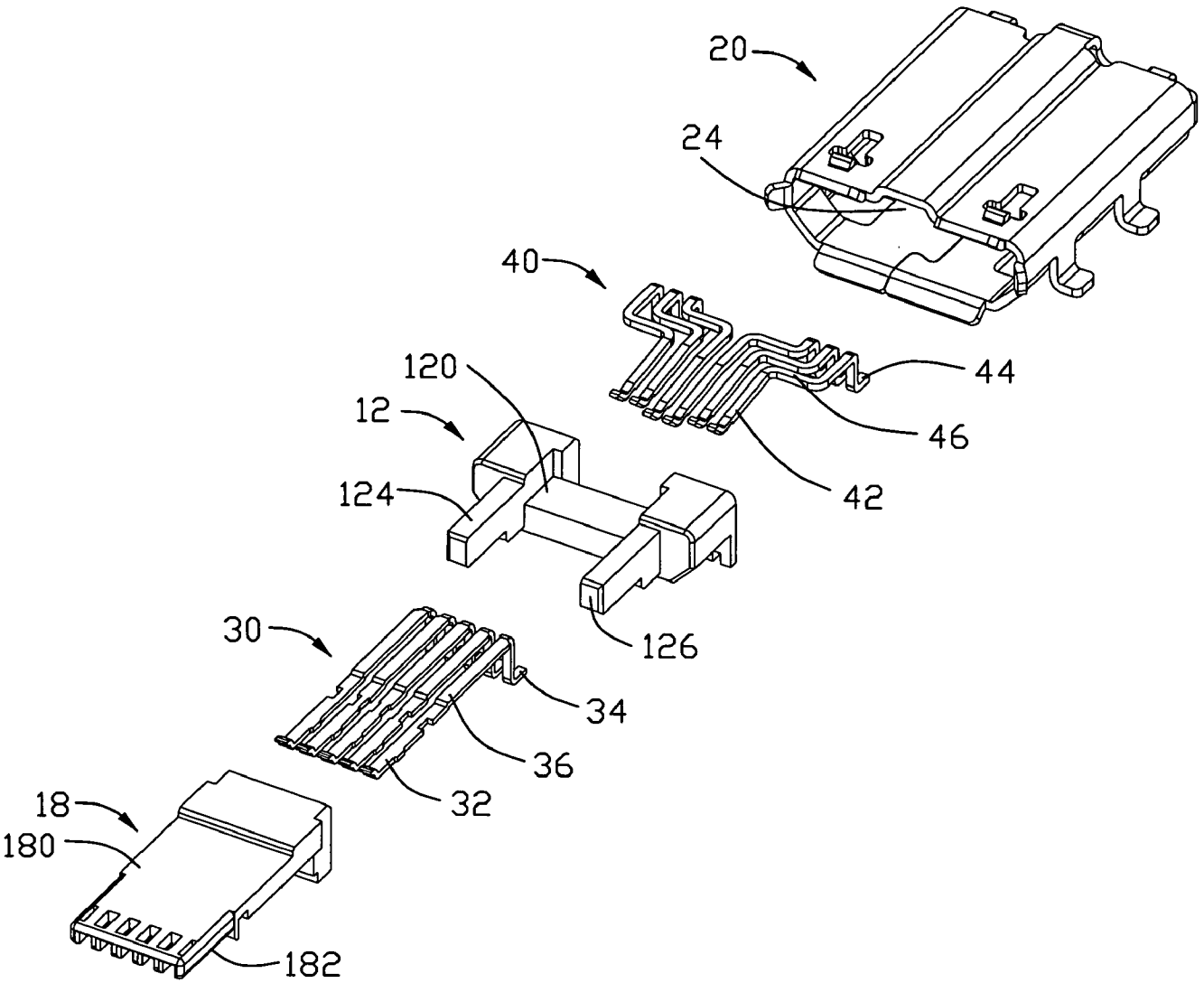
FIG. 2 is an exploded view of the electrical receptacle shown in FIG. 1.

Referring to FIGS. 1-2, an electrical receptacle 100 according to a preferred embodiment of the present invention is employed in an electronic device (not shown). The electrical receptacle 100 is electrically coupled to a circuit board (not shown) of the electronic device, allows for transmitting USB 2.0 signals and other extended signals with two type of mating plugs 200, 400 (shown in FIGS. 10 and 12). The receptacle 100 includes an insulative body 10, a metal shell 20 surrounding the insulative body 10, a group of first contacts 30, and a group of second contacts 40.

Figure 3:
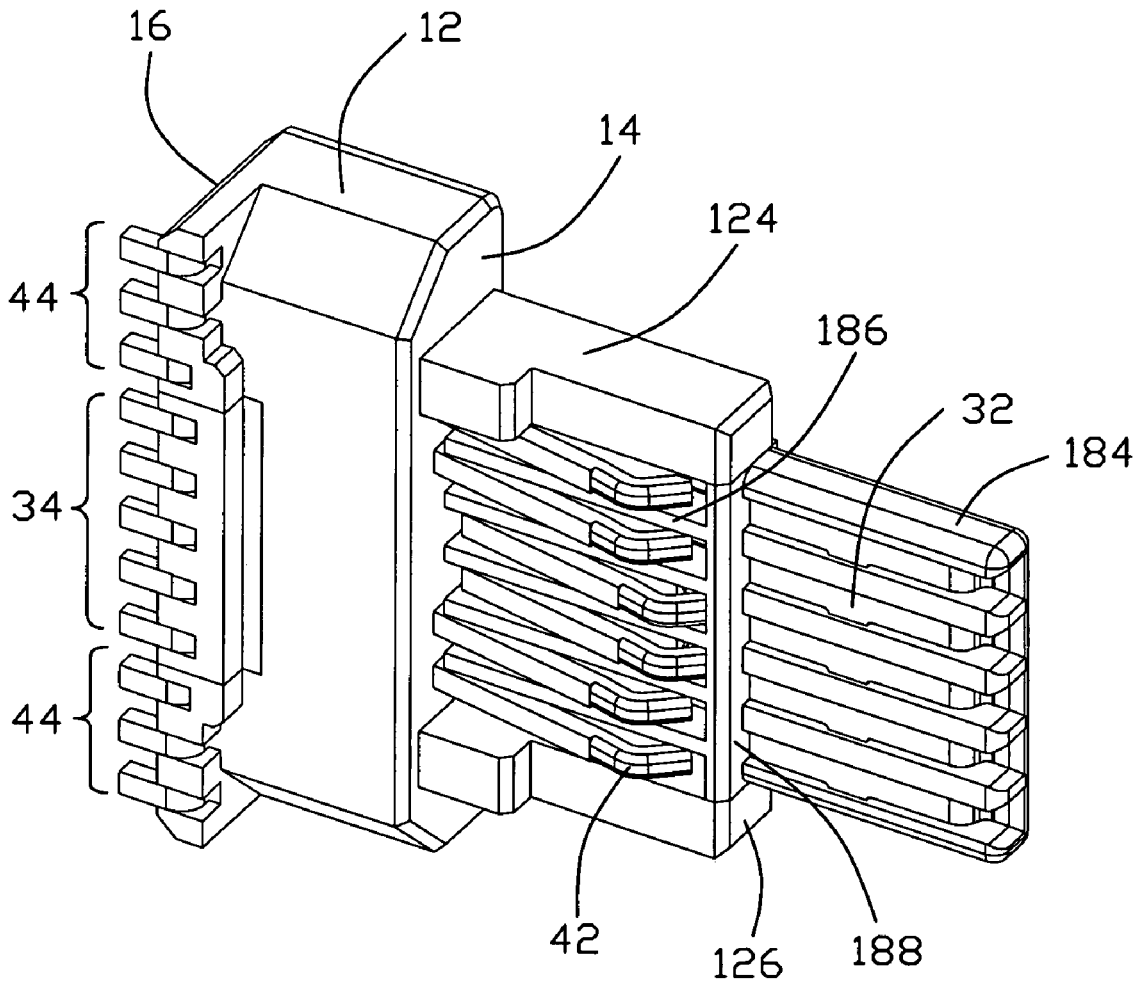
FIG. 3 is a perspective view of the electrical contacts and the insulative body shown in FIG. 2.
Figure 4:
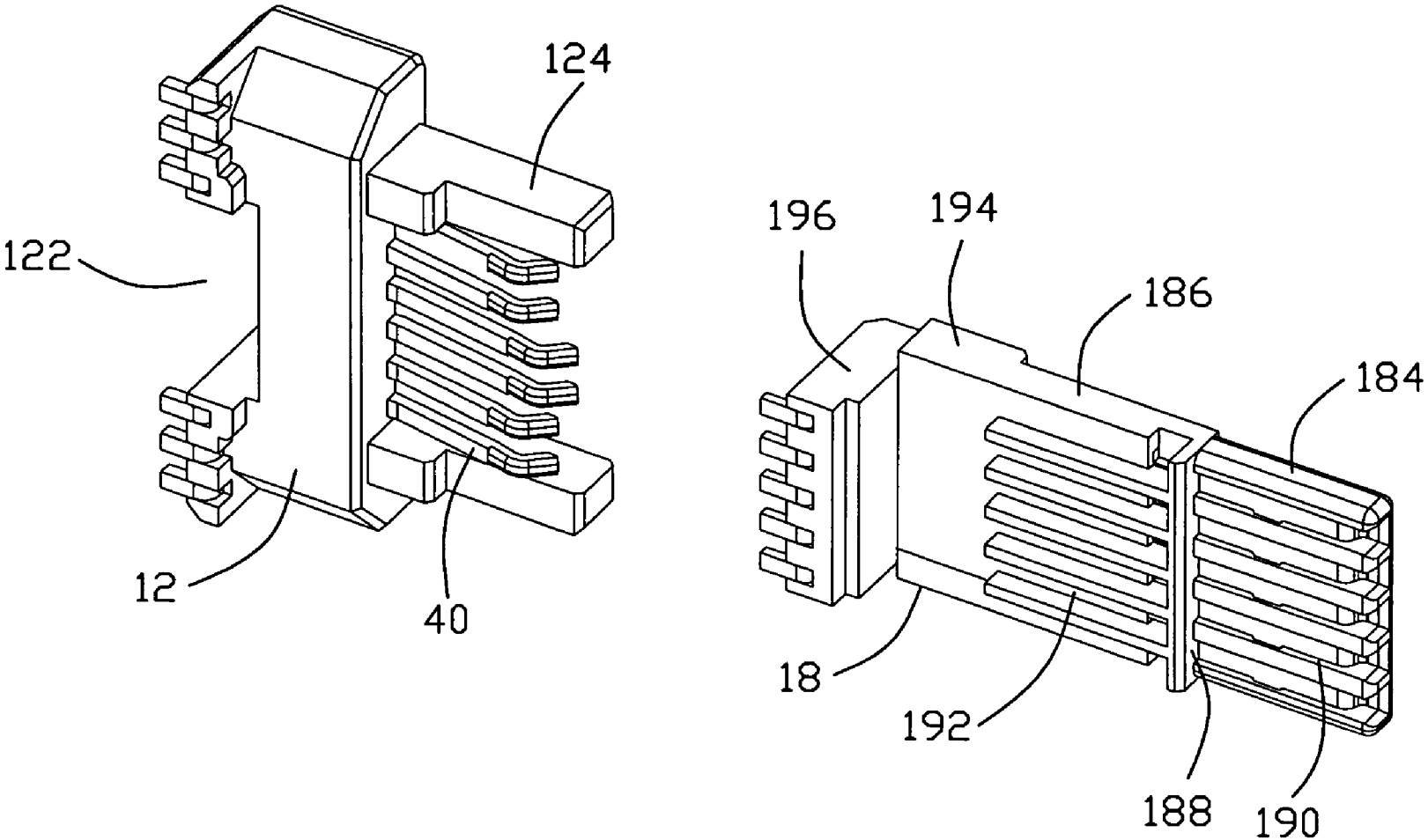
FIG. 4 is an exploded view of the electrical contacts and the insulative body shown in FIG. 3.
Figure 5:
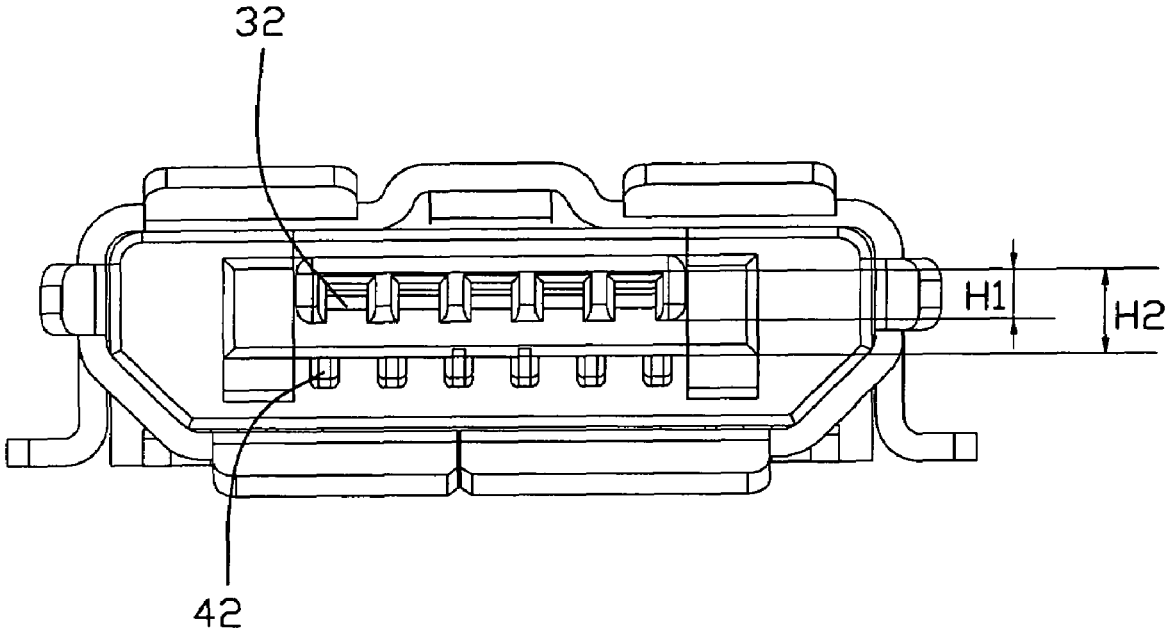
FIG. 5 is a front view of the electrical receptacle shown in FIG. 1.
Figure 6:
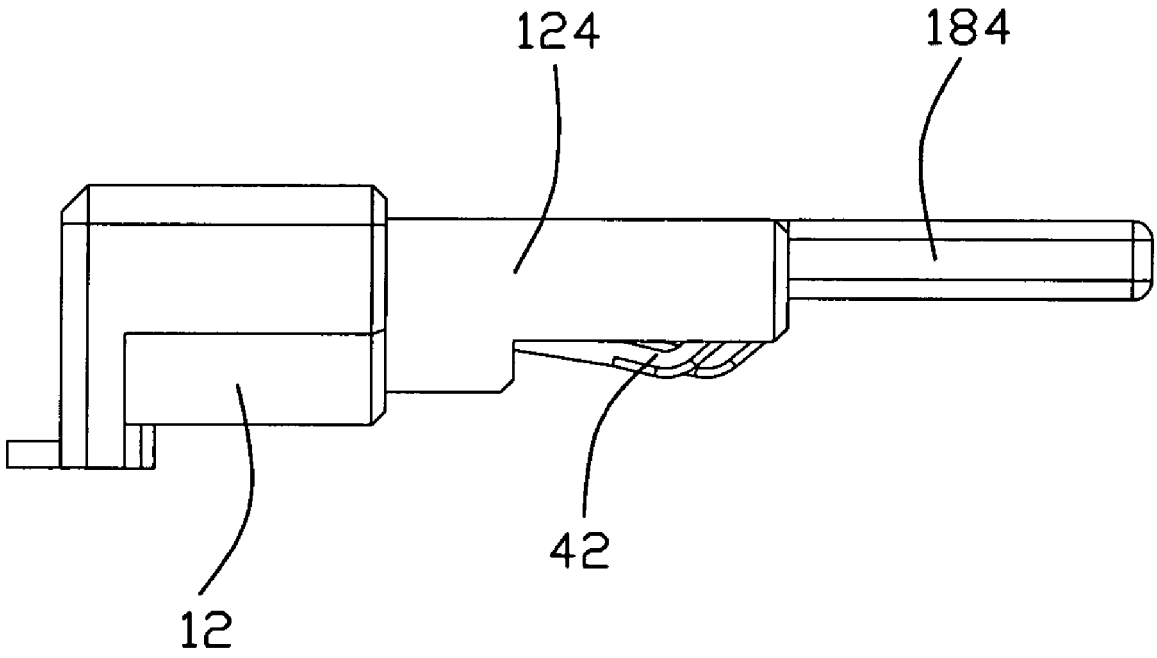
FIG. 6 is a side view of the electrical contacts and the insulative body shown in FIG. 3.

Referring to FIGS. 3 and 4, the insulative body 10 includes a seat 12 having a front surface 14 and a rear surface 16, and a scalar mating plate 18 projecting forwardly from the front surface 14 of the seat 12 along a mating direction of the receptacle 100. The mating plate 18 is provided with two opposite up and bottom sides 180, 182. The seat 12 forms a first recess 120 in a middle portion thereof for positioning the mating plate 18 thereon. The mating plate 18 comprises a first step section 184 at a front end thereof and a second step section 186 at a rear end thereof along the mating direction. A front separating surface 188 is provided on the mating plate 18 for separating the first step section 184 and the second step section 186. The height of the first step section 184 is presented by H1 and the height of the second step section 186 is presented by H2, and wherein H2 is bigger than H1, as shown in FIG. 5. Each step section 184, 186 defines a plurality of passageways 190, 192 respectively at the lower side 182.

The mating plate 18 further has a project portion 196 at a rear end thereof which is received in a second recess 122 of the seat 12. Although the mating plate 18 is separated from the seat 12 in the preferred embodiment, the mating plate 18 and the seat 12 also may be integrated. The seat 12 further has a pair of guiding posts 124 located at opposite lateral sides of the mating plate 18 which provides an end face 126 copular to the separating face 188 of the mating plate 18 when the mating plate 18 attached to the seat 12. The shell 20 has an opening 22 at a front end thereof for insertion of the mating plugs 200, 400. The shell 20 and the insulative body 10 define a receiving space 26 behind the opening 22 for receive the mating plugs 200, 400 therein.

Figure 10:
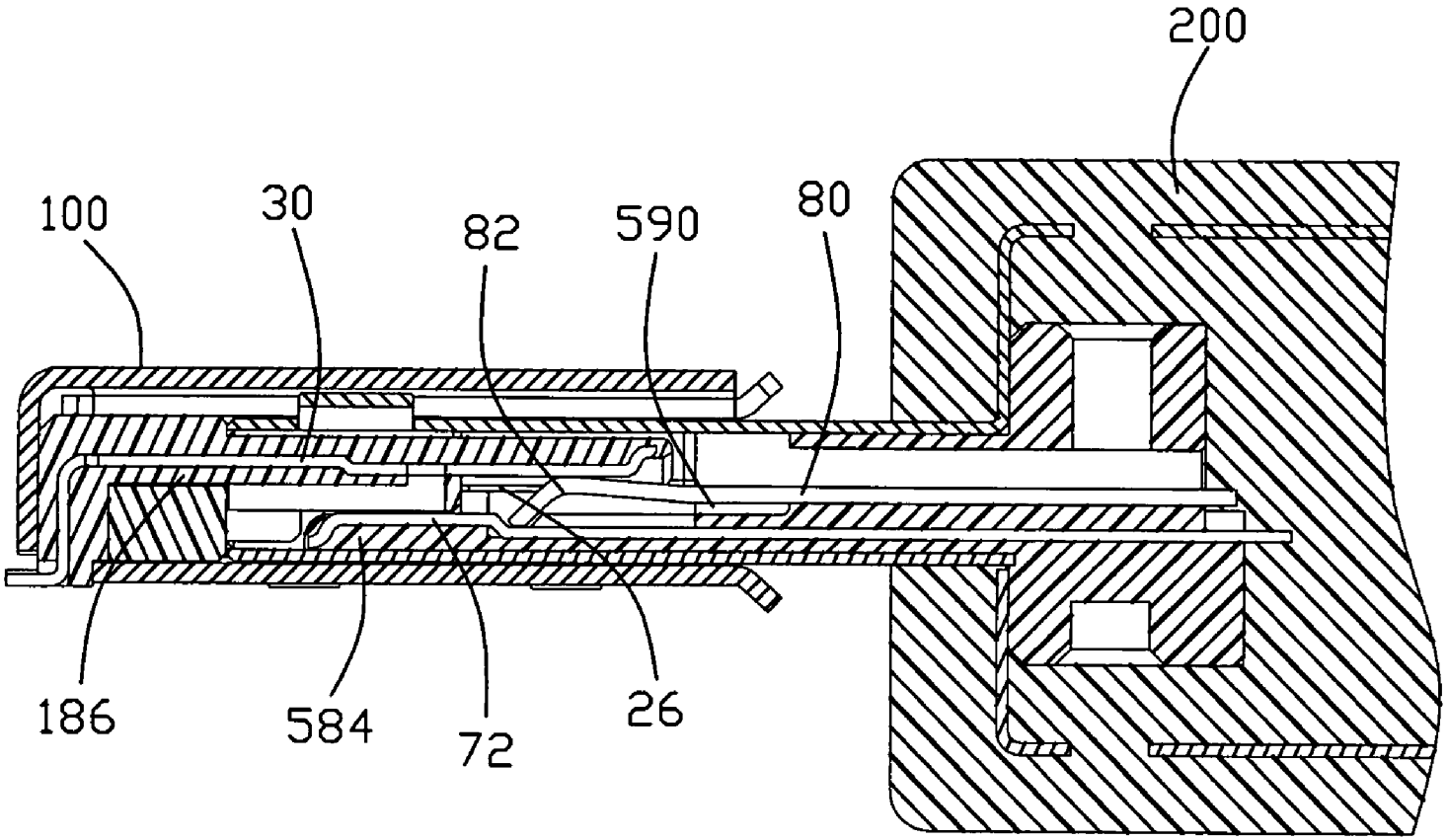
FIG. 10 is a sectional view of the electrical receptacle and the plug, illustrating the first contacts of the receptacle contacting with the second contacts of the plug.
Figure 11:
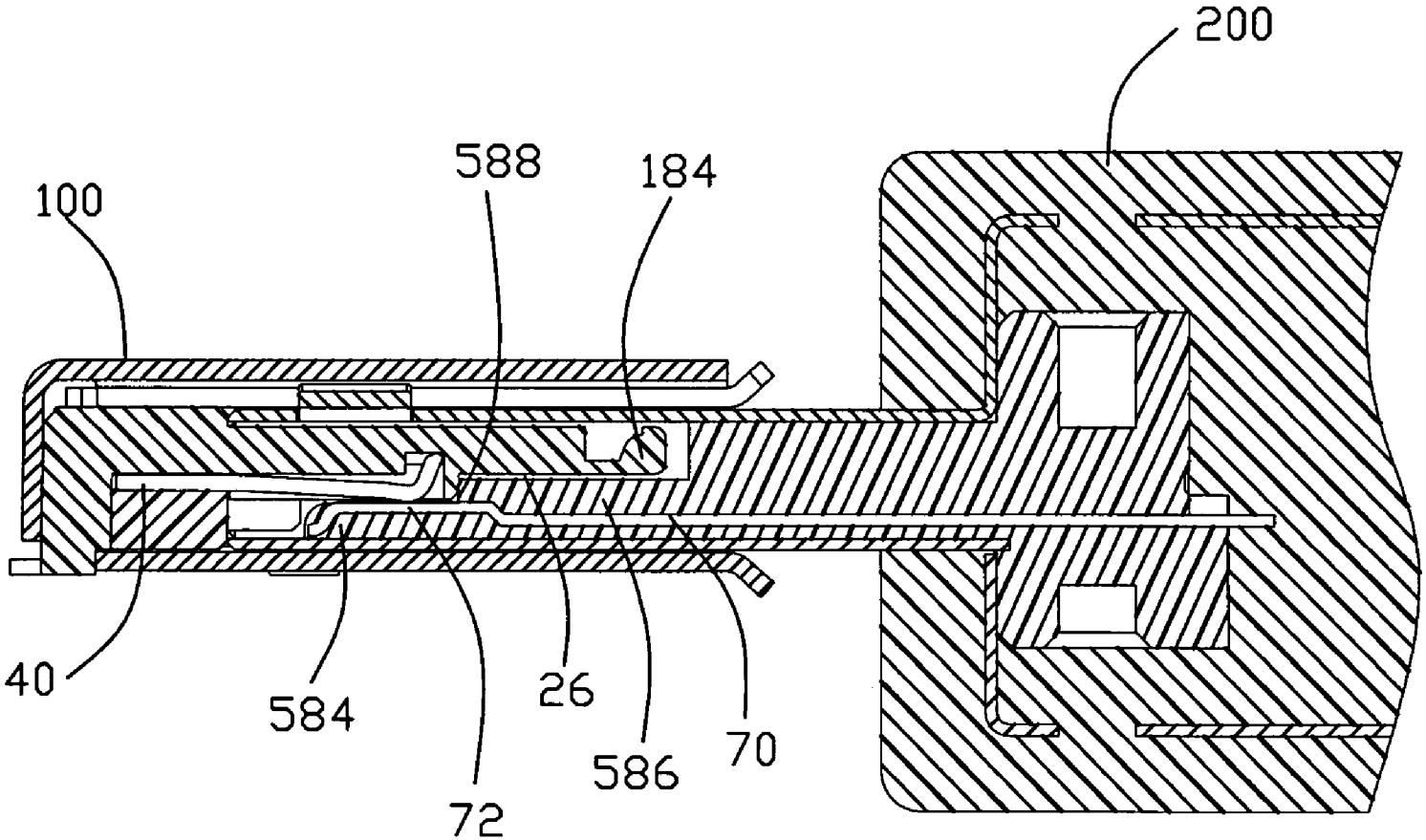
FIG. 11 is a view similar to FIG. 10, illustrating the second contacts of the receptacle contacting with the first contacts of the plug.
Figure 12:
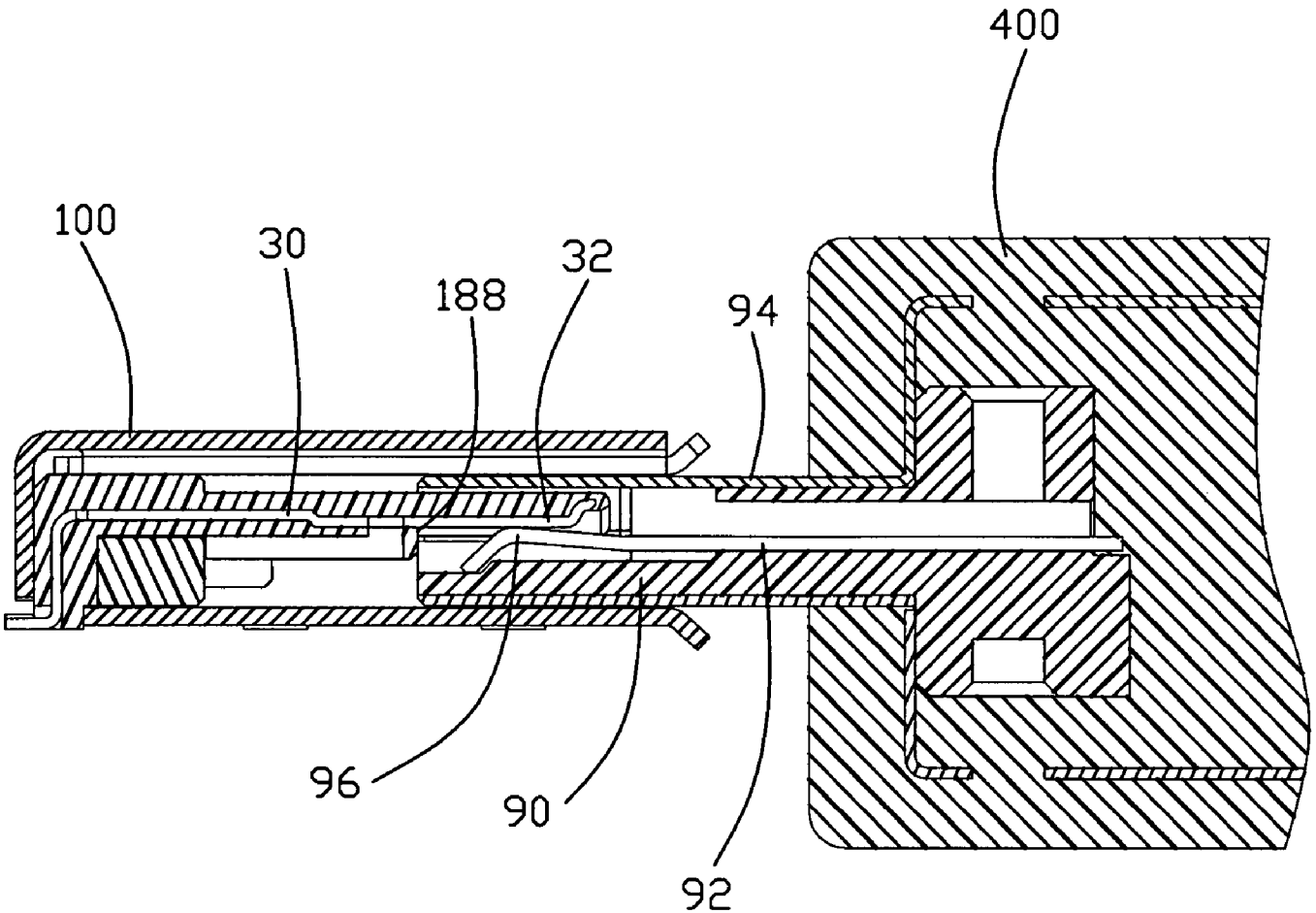
FIG. 12 is a sectional view of the electrical receptacle and a standard USB 2.0 plug, showing the first contacts contacting with the contacts of the USB 2.0 plug.

Referring now to FIGS. 2 through 6, the structure and arrangement of the contacts will be discussed in greater detail. Each contact 30, 40 includes a contacts end 32, 42, a solder end 34, 44 mounting to the circuit board, and a connecting portion 36, 46 located therebetween. The group of first contacts 30 can mate with corresponding contacts 80, 90 of the mating plug 200, 400 as shown in FIGS. 10 and 12, respectively. The group of second contacts 40 only can mate with the corresponding contacts 70 of the plug 200 as shown in FIG. 11. The first contacts 30 and the second contacts 40 may be supported by the insulative body 10 by any desired conventional means. For example, the contacts 30, 40 can be inserted into the housing body 10 or they may be molded on the housing body 10 as described in the preferred embodiment. The first contacts 30 and the second contacts 40 are insert molded to the mating tongue 18 and the seat 12, respectively.

The contact ends 32. 42 of the first and second contacts 30, 40 are disposed in the passageways 190, 192 respectively and located on the bottom side 182 of the mating plate 18. The contact ends 32 of the first contacts 30 are arranged on the first step section 184 and the contact ends 42 of the second contacts 40 are arranged on the second step section 186 thereby forms a first mating region and a second mating region along the mating direction.

The first contact ends 32 are flat and the second contact ends 42 are elastic. The solder ends 34, 44 of the first and second contacts 30, 40 are arranged in one row. The connecting portions 46 of the second contacts 40 has a deflection with respect to the contact ends 42 by which the solder ends 34 of the first contacts 30 are located in a middle portion in the row and sandwiched by the solder ends 44 of the second contacts 40.

Figure 7:
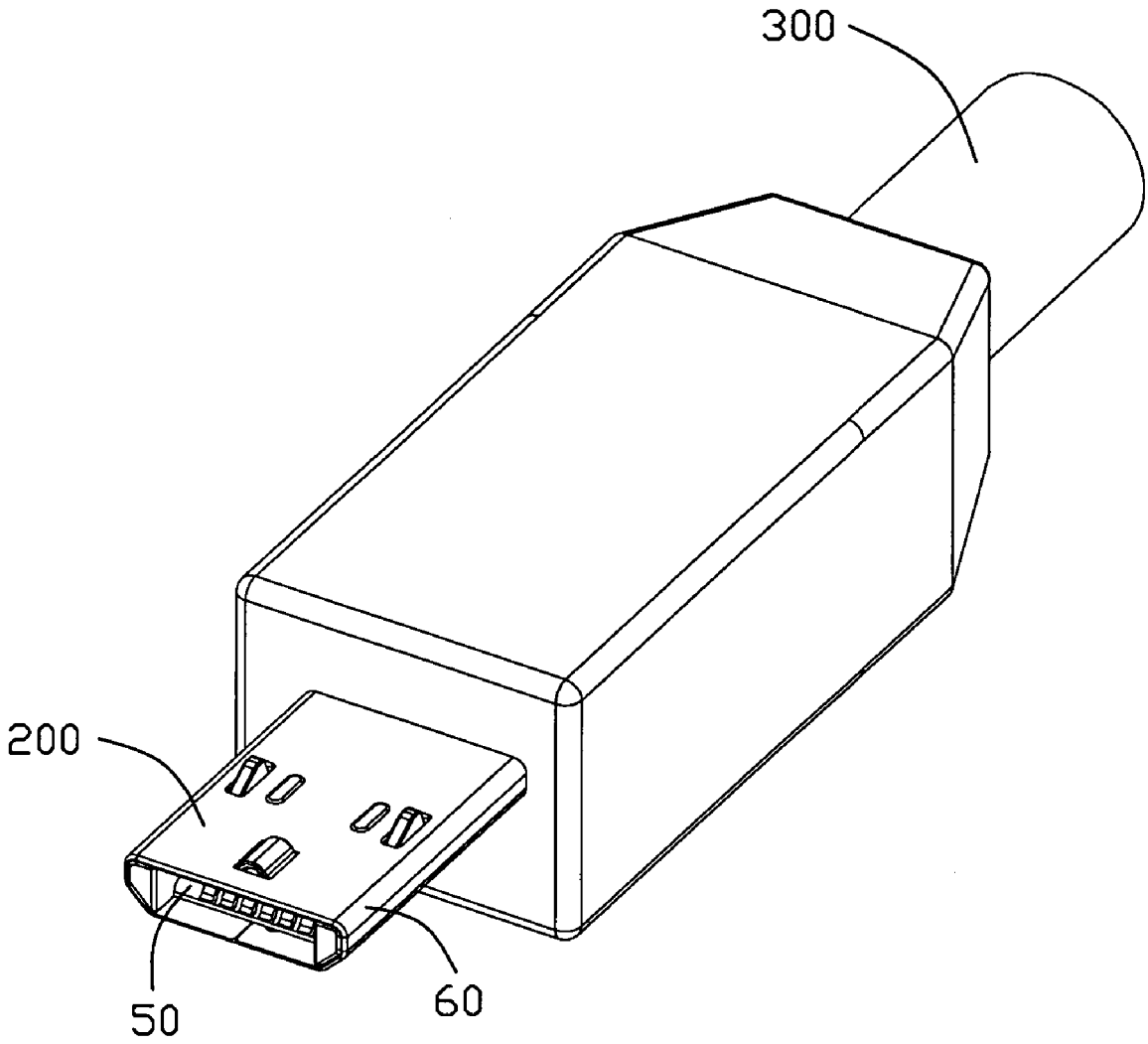
FIG. 7 is a perspective view of an electrical plug and a cable according to the present invention.
Figure 8:
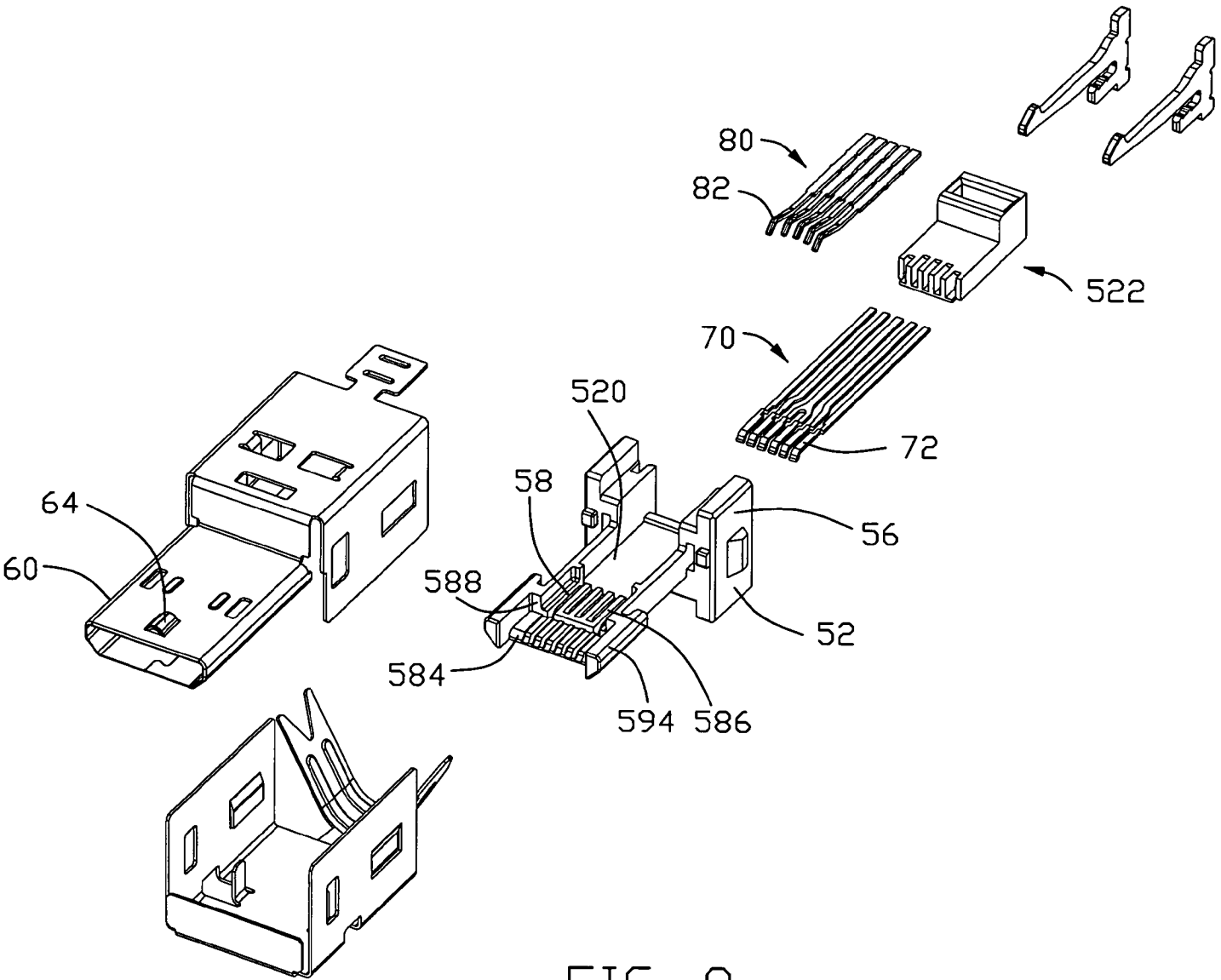
FIG. 8 is an exploded view of the electrical plug shown in FIG. 7.
Figure 9:
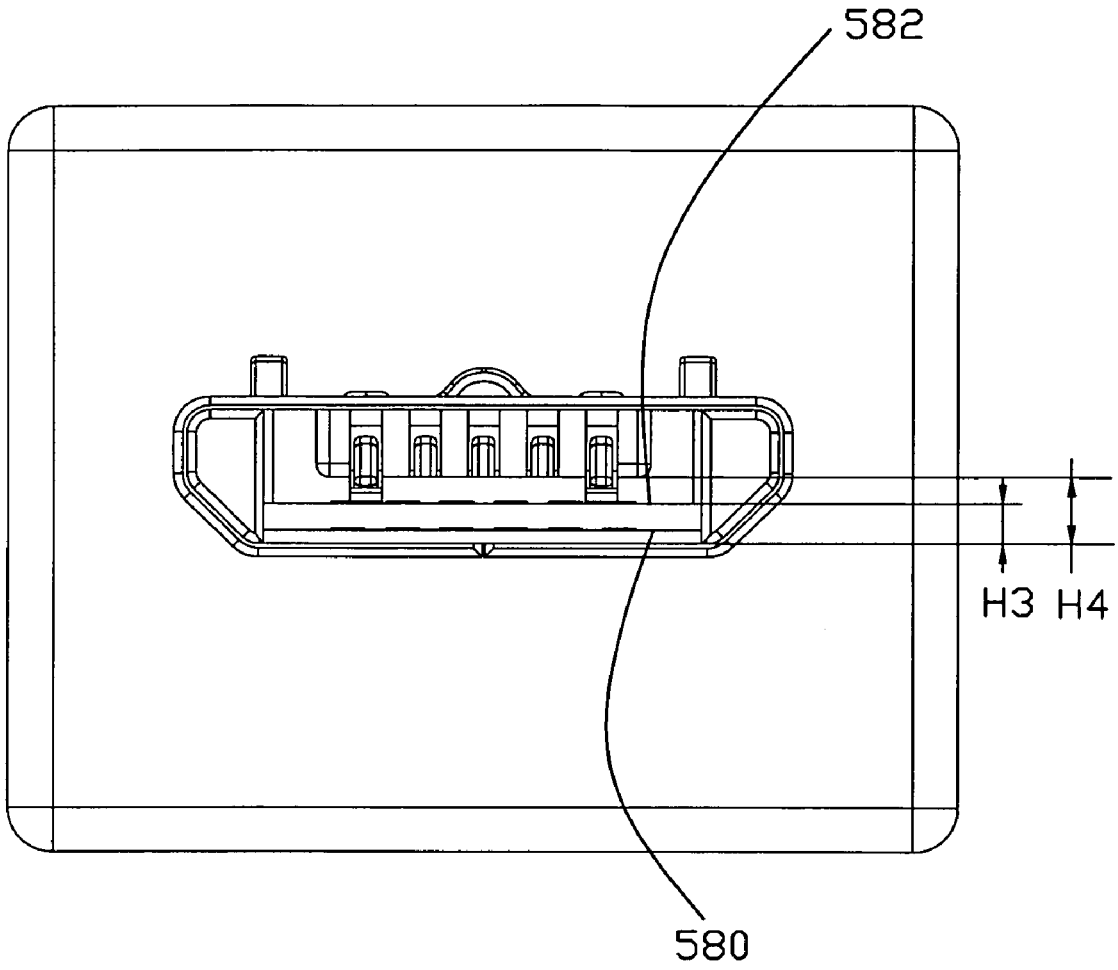
FIG. 9 is a front view of the electrical plug shown in FIG. 7.

Referring to FIGS. 7 to 9, a first mating plug 200 according to the prefer embodiment is electrically connected with a cable 300, which includes an insulative body 50, a metal shell 60, and a plurality of plug contacts engaged with the body 50. The insulative body 20 has an insulative seat 52 and a scalar mating plate 58 projecting from the seat 52. The mating plate 58 is provided with opposite up and bottom sides 580, 582 and includes a first step section 584 and a second step section 582 located between the first step 584 and the seat 52. The shell 60 surrounds the seat 52 and the mating plate 58, and has a protrusion 64 thereon. A groove 24 is formed on the shell 20 of the receptacle 100 for receiving the protrusion 64 therein.

The plug contacts include a group of first contacts 70 arranged on the first step section 584 and a group of second contacts 80 arranged on the second step section 586. The first contacts 70 and the second contacts 80 each have a contact end 72, 82 which are located on the same side 582 of the mating plate 58. The contact ends 72 of the first contacts 70 are flat and located on a front portion of the mating plate 58, and the contact ends 82 of the second contacts 80 are elastic and located on a rear section of the mating plate 58.

The mating plate 58 also has a separating surface 588 located between the contact ends 72, 82 of the first contacts 70 and the second contacts 80. The height of the first step section 584 is presented by H3 and the height of the second step section 586 is presented by H4, and wherein H4 is bigger than H3. Two posts 594 are provided at two lateral sides of the mating plate 58 and project forwardly from the first step section 584.

The plug contacts can be inserted into the housing body 50 or they may be molded on the housing body 50 as described in the preferred embodiment. The seat 52 and the mating plate 58 are integral and the first contacts 70 are molded thereon. The second contacts 80 are molded on another insert 522 and the contact ends 82 thereof are exposed on the mating plate 58. The insert 522 is retained on a recess 520 of the seat 52.

When the receptacle 100 mating with the plug 200, the plug 200 first passes the opening 22 and then it further inserts into the receiving space 26, until it reaches the front face 14 of the seat 12. As shown in FIGS. 10 and 11, the front edge of the shell 60 and the posts 594 are contacting with the front face 14 of seat 12. The separating face 588 of the plug 200 confronts the separating face 188 of the receptacle. The first and second group of contacts 30, 40 of the receptacle 100 engage with the second and first group of contacts 80, 70 of the plug 200, respectively. Therefore, the flat contacts 30, 70 are mating with the elastic contacts 80, 40 in the plug 200 and the receptacle 100. In each of the plug and the receptacle, the group of first contacts 30, 70 and the group of second contacts 80, 40 are located at different heights, which results in two different mating positions in a vertical direction.

As an example, the first contacts 30 of the receptacle 100 and the second contacts 80 of the plug 200 are transmit micro USB signals. The first contacts 30 and the first step section 184 of the receptacle 100 and the second contacts 80 and the second step section 586 of the plug 200 may be configured to allow for the reception of various types of USB 2.0 connectors. The second contacts 40 of receptacle 100 and the first group contacts 70 of the plug 200 are extended to the USB 2.0 connectors. In each of the receptacle 100 and the plug 200, the extended contacts 40, 70 include two differential pairs at outer sides thereof and a grounding contacts located between the two pairs.

As shown in FIG. 12, the receptacle 100 is further adapted for receiving a USB 2.0 plug 400 since the front step section 184 and the group of first contacts are configured to a USB 2.0 receptacle. The plug 400 includes an insulative body 90, a plurality of contacts 92 retained on the insulative body 90, and a metal shell 94 surrounding the body 90 and the contacts 92. During mating with the receptacle 100, the plug 400 is first inserted the opening 22 and then with further insertion front edges of the insulative body 90 and the shell 94 reach separating surface 188 of the mating plate 18. Since the plug 400 is stopped by the separating surface 188, it will not further inserted into the receptacle 100. Each contact 92 has a contact end 96 for connecting with the first contacts 30 of the receptacle 100.

The receptacle 100 and the extended plug 200 according to the preferred embodiment of the present invention are able to transmit both USB-compliant and other signals. The extended contacts 40, 70 also can transmit USB signals. Hence, the electrical device to which the receptacle 100 and the plug 200 are applied not only is backward compatible of USB 2.0 signals but also can increasing the transmitting speed. While the drawings display a USB system, the present invention could be used with any type of electrical connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector, comprising:

an insulative body including a seat and a mating plate projecting outwardly from the seat which has opposite first and second sides, the mating plate further having a first mating section at a front end thereof and a second mating section behind the first mating section;

a shell surrounding the seat and the mating plate and defining an opening at a front end thereof;

a plurality of first contacts each comprising a contact end arranged on the first mating section; and a plurality of second contacts each comprising a contact end arranged on the second mating section;

wherein the contact ends of the first and second contacts are located on the same side of the mating plate, and wherein the second mating section is thicker than the first mating section;

wherein the mating plate is provided with a front surface located between the first and the second mating sections and confronting to the opening of the shell;

wherein the front face is disposed between the contact ends of the first contacts and the contacts ends of the second contacts;

wherein a pair of posts project from the seat, and wherein each post has an end face copular to the front face.

2. The electrical connector as claimed in claim 1, wherein the contact ends of the first contacts are flat, and the contact ends of the second contacts are elastic.

3. The electrical connector as claimed in claim 1, wherein the contact ends of the first contacts and the contact ends of the second contacts are located at different heights.

4. The electrical connector as claimed in claim 1, wherein the mating plate is separated from the seat, and wherein the first contacts are insert-molded on the mating plate and the second contacts are insert-molded on the seat.

5. The electrical connector as claimed in claim 4, wherein each first and second contacts comprises a solder end to be arranged in one row, and wherein the solder ends of the first contacts are sandwiched by the solder ends of the second contacts.

6. An electrical connector assembly, comprising:

a receptacle and a plug matable with the receptacle;

said receptacle including:

an insulative body comprising a seat and a scalar mating plate projecting outwardly from the seat, the mating plate having a first step and a second step located between the first step and the seat;

a plurality of first contacts arranged on the first step; and a plurality of second contacts arranged on the second step;

the plug comprising:

an insulative seat and a scalar mating plate projecting from the seat, the mating plate including a first step and a second step located between the first step and the seat;

a plurality of third contacts arranged on the first step for mating with the second contacts; and a plurality of forth contacts arranged on the second step for mating with the first contacts of the receptacle;

wherein the receptacle further includes a stop surface separating the first step and the second step, and wherein when the plug is inserted into the receptacle, the stop surface contacts with the second step of the plug.

7. The electrical connector assembly as claimed in claim 6, wherein the first and the third contacts are flat, and the second and the forth contacts are elastic.

8. The electrical connector assembly as claimed in claim 6, wherein the first contact and the second contacts are located at the same side of the mating plate of the receptacle, and the third and the forth contacts are located at the same side of the mating plate of the plug.

9. The electrical connector assembly as claimed in claim 6, wherein the first contacts and the forth contacts transmit USB 2.0 signals.

10. The electrical connector assembly as claimed in claim 6, wherein the second contacts include two differential pairs, and the forth contacts of the plug include two differential pairs corresponding to the receptacle.

11. The electrical connector assembly as claimed in claim 6, wherein the receptacle and the plug each comprises a shell surrounding the seat and the mating plate, and wherein a protrusion is formed on the shell of plug, and a groove is formed on the shell of the receptacle for receiving the protrusion therein.

12. The electrical connector assembly as claimed in claim 6, wherein the front step of the receptacle is configured to a USB 2.0 receptacle, which is further adapted for mating with a USB 2.0 plug.

13. The electrical connector assembly as claimed in claim 6, wherein two posts are provided at two lateral sides of the mating plate of the plug for confronting the seat of the receptacle.

14. An electrical connector comprising:

a first insulative housing unit defining on a same side a plurality of first grooves at a first level and a plurality of second grooves at a second level different from the first level under a condition that the first groove is longer than the second groove;

a second insulative housing unit stacked upon the first housing while exposing both the first grooves and the second grooves;

a plurality of first type contacts disposed in the corresponding first grooves, respectively;

a plurality of second type contacts disposed in the corresponding second grooves, respectively; wherein the first type contacts are longer than the second type contacts;

wherein each of the fist type contacts defines a straight type mating section while each of the second type contacts defines a curved type mating section;

wherein each of the first type contacts are essentially fully surrounded in the first housing while the second type contacts are essentially sandwiched between the first housing and the second housing.

* * * * *